US011112108B2

(12) United States Patent
Jordan

(10) Patent No.: US 11,112,108 B2
(45) Date of Patent: Sep. 7, 2021

(54) SUPERHEATED STEAM BOILER AND METHOD FOR OPERATION THEREOF

(71) Applicant: Suspended Vortex Innovations LLC, Springtown, TX (US)

(72) Inventor: Michael Wayne Jordan, Weatherford, TX (US)

(73) Assignee: SUSPENDED VORTEX INNOVATIONS LLC, Springtown, TX (US)

( * ) Notice: Subject to any disclaimer, the term of this patent is extended or adjusted under 35 U.S.C. 154(b) by 573 days.

(21) Appl. No.: 16/077,822

(22) PCT Filed: May 31, 2018

(86) PCT No.: PCT/US2018/035438
§ 371 (c)(1),
(2) Date: Aug. 14, 2018

(87) PCT Pub. No.: WO2018/226509
PCT Pub. Date: Dec. 13, 2018

(65) Prior Publication Data

US 2021/0199282 A1 Jul. 1, 2021

Related U.S. Application Data

(60) Provisional application No. 62/515,350, filed on Jun. 5, 2017.

(51) Int. Cl.
*F22B 1/22* (2006.01)
*F22G 1/02* (2006.01)
(Continued)

(52) U.S. Cl.
CPC ..... *F22B 1/22* (2013.01); *F22B 9/04* (2013.01); *F22B 13/023* (2013.01); *F22B 27/14* (2013.01); *F22B 37/36* (2013.01); *F22G 1/02* (2013.01)

(58) Field of Classification Search
CPC ..... F22B 1/22
See application file for complete search history.

(56) References Cited

U.S. PATENT DOCUMENTS 1,611,364 A 12/1926 Parker
1,754,472 A 4/1930 Kuenhold
(Continued)

*Primary Examiner* — Nathaniel Herzfeld
(74) *Attorney, Agent, or Firm* — Pearl Cohen Zedek Latzer Baratz LLP

(57) ABSTRACT

A superheated steam boiler includes an inner tank system including a wet tank and a dry tank separated by an isolation member, an outer sleeve surrounding the inner tank system, wherein wet tank fluid openings allow the wet tank to be in communication with the outer sleeve, and dry tank steam openings in the dry tank allow the dry tank to be in communication with the outer sleeve, and a burner system within the inner tank system. The burner system includes a combustion/expansion chamber having spherical surfaces located in and fluidly isolated from the wet tank, a distribution chamber located in and fluidly isolated from the dry tank, heat tubes extending through the isolation member between the combustion/expansion chamber and the distribution chamber; and an exhaust tube extending from the distribution chamber and out of the inner tank system to exit the boiler.

20 Claims, 6 Drawing Sheets

(51) Int. Cl.

| | |
|---|---|
| ***F22B 9/04*** | (2006.01) |
| ***F22B 27/14*** | (2006.01) |
| ***F22B 37/36*** | (2006.01) |
| ***F22B 13/02*** | (2006.01) |

(56) References Cited

U.S. PATENT DOCUMENTS

| | | | | | |
|---|---|---|---|---|---|
| 1,873,838 | A | | 8/1932 | Gebhard | |
| 2,727,495 | A | | 12/1955 | Genzaburo Matsumoto et al. | |
| 2,859,736 | A | * | 11/1958 | Balton | F22B 21/005 122/118 |
| 2,965,079 | A | | 12/1960 | Collinson | |
| 3,243,575 | A | | 3/1966 | Vignere, Sr. | |
| 3,610,788 | A | * | 10/1971 | Brenner | F22B 33/08 431/9 |
| 4,259,928 | A | | 4/1981 | Huber | |
| 4,280,450 | A | * | 7/1981 | Maruyama | F24H 1/287 122/13.01 |
| 4,488,513 | A | | 12/1984 | Jahnke et al. | |
| 4,569,310 | A | | 2/1986 | Davis | |
| 4,683,842 | A | | 8/1987 | Keintzel et al. | |
| 5,950,573 | A | | 9/1999 | Shellenberger et al. | |
| 6,070,559 | A | * | 6/2000 | Schlesch | F22B 7/00 122/140.1 |
| 8,246,915 | B2 | | 8/2012 | Boer et al. | |
| 10,048,016 | B2 | * | 8/2018 | Jordan | F24H 8/00 |

* cited by examiner

500

| Time Sec. | A. Exhaust (°F) | B. Liquid in Outer Sleeve (°F) | C. Superheated Steam Outlet (°F) | D. Outer Water Jacket (°F) | E. Upper Surface of Upper Sleeve (0 Deg. Rotation) (°F) | F. Upper Surface of Upper Sleeve (180 Deg. Rotation) (°F) | G. Upper Surface of Upper Sleeve (90 Deg. Rotation) (°F) | H. Midpoint of Upper Sleeve (about 180 Deg. Rotation) (°F) |
|---|---|---|---|---|---|---|---|---|
| 0 | 69.26 | 59.99 | 71.53 | 62.42 | 60.07 | 59.99 | 60.41 | 60.99 |
| 15 | 77.72 | 60.01 | 71.55 | 62.75 | 68.59 | 64.8 | 64.73 | 64.33 |
| 30 | 86.83 | 63.04 | 71.56 | 62.79 | 79.84 | 70.08 | 68.07 | 70.7 |
| 45 | 91.03 | 68.44 | 71.58 | 62.92 | 97.72 | 78.75 | 75.39 | 74.89 |
| 60 | 95.04 | 69.92 | 71.58 | 63.1 | 111.5 | 93.72 | 86.35 | 85.13 |
| 75 | 98.61 | 76.41 | 71.62 | 63.29 | 133.53 | 102.78 | 97.2 | 89.64 |
| 90 | 101.51 | 81.49 | 71.64 | 63.66 | 145.43 | 114.31 | 111.12 | 98.25 |
| 105 | 104.13 | 88 | 71.68 | 64.44 | 169.77 | 122.78 | 122.1 | 105.64 |
| 120 | 106.19 | 94.98 | 71.67 | 65.44 | 183.4 | 137.33 | 132.4 | 115.82 |
| 135 | 108.02 | 102.8 | 71.69 | 66.86 | 198.43 | 141.25 | 141.39 | 126.67 |
| 150 | 109.59 | 109.14 | 71.65 | 68.7 | 212.06 | 157.03 | 156.43 | 141.37 |
| 165 | 110.98 | 115.02 | 71.63 | 71.42 | 221.46 | 167.47 | 171.17 | 149.5 |
| 180 | 112.26 | 123.21 | 71.64 | 74.12 | 234.83 | 176.54 | 187.74 | 161.31 |
| 195 | 113.67 | 131.42 | 71.66 | 77.88 | 248.12 | 188.92 | 185.56 | 178.65 |
| 210 | 114.82 | 139.11 | 71.67 | 82.11 | 248.74 | 209.44 | 205.12 | 193.15 |
| 225 | 115.57 | 148.93 | 71.7 | 88.19 | 275.51 | 215.38 | 223.98 | 207.71 |
| 240 | 118.37 | 159.31 | 71.75 | 94.65 | 273.69 | 231.73 | 228.71 | 216.27 |
| 255 | 119.27 | 170.85 | 71.79 | 87.06 | 303.72 | 251.82 | 235.86 | 227.91 |
| 270 | 119.84 | 180.3 | 71.82 | 83.83 | 324.24 | 261.88 | 246.95 | 243.43 |
| 285 | 120.49 | 186 | 71.82 | 97.5 | 331.1 | 271.24 | 245.8 | 254 |
| 300 | 121.8 | 194.86 | 71.83 | 103.9 | 345.48 | 283.22 | 256.76 | 263.72 |
| 315 | 122.61 | 200.73 | 71.85 | 110.37 | 359.77 | 283.7 | 251.42 | 270.51 |
| 330 | 123.19 | 207.44 | 71.9 | 116.92 | 369.82 | 304.82 | 266.04 | 283.84 |
| 345 | 123.7 | 213.44 | 71.9 | 120.97 | 380.52 | 313.69 | 267.33 | 293.26 |
| 360 | 124.44 | 218.59 | 71.93 | 131.07 | 376.79 | 317.05 | 273.51 | 304.35 |
| 375 | 124.9 | 224.43 | 71.97 | 134.88 | 402.84 | 328.26 | 283.23 | 313.93 |
| 390 | 125.38 | 237.34 | 114.55 | 138.27 | 410.89 | 322.55 | 255.64 | 336.96 |
| 405 | 125.77 | 231.38 | 161.96 | 144.56 | 405.81 | 320.29 | 257.19 | 353.64 |
| 420 | 126.23 | 231.19 | 118.86 | 154.43 | 435.47 | 332.83 | 268.65 | 351.56 |
| 435 | 126.85 | 233.9 | 114.79 | 180.79 | 435.05 | 335.2 | 273.37 | 353.01 |
| 450 | 127.4 | 235.87 | 112.14 | 206.83 | 452.97 | 341.15 | 285.57 | 354.33 |
| 465 | 128.77 | 237.9 | 110.38 | 223.92 | 445.88 | 346.34 | 281.04 | 352.87 |
| 480 | 176.91 | 241.46 | 108.98 | 239.64 | 456.85 | 352.64 | 283.43 | 362.4 |
| 495 | 179.83 | 246.28 | 107.05 | 252.86 | 456.3 | 369.96 | 295.57 | 366.49 |
| 510 | 182.44 | 248.9 | 106.38 | 260.07 | 457.07 | 371.01 | 305.88 | 370.95 |
| 525 | 184.71 | 250.58 | 208.62 | 258.53 | 464.47 | 373.9 | 298.73 | 378.4 |
| 547 | 189.29 | 251.92 | 210.37 | 259.72 | 478.61 | 384.22 | 308.64 | 392.88 |
| 555 | 191.24 | 253.49 | 210.31 | 259.13 | 474.53 | 373.78 | 311.7 | 384.13 |
| 570 | 194.53 | 253.53 | 210.44 | 256.48 | 472.57 | 385.39 | 304.42 | 405.56 |
| 585 | 196.95 | 252.79 | 293.96 | 255.44 | 466.69 | 409.38 | 297.31 | 434.42 |
| 600 | 200.07 | 252.63 | 315.47 | 253.52 | 471.54 | 399.37 | 299.67 | 428.27 |
| 615 | 202.4 | 251.29 | 326.05 | 249.45 | 474.29 | 397.85 | 290.57 | 428.99 |
| 630 | 203.86 | 250.28 | 329.14 | 246.2 | 469.66 | 409.56 | 296.85 | 434.77 |
| 645 | 205.42 | 249.24 | 336.08 | 244.34 | 471.13 | 409.49 | 292.02 | 438.46 |
| 660 | 205.34 | 248.95 | 342.28 | 242.88 | 466.82 | 412.38 | 298.07 | 440.29 |
| 675 | 205.92 | 248.63 | 347.51 | 241.53 | 477.7 | 417.18 | 294.22 | 441.56 |
| 690 | 206.62 | 248.25 | 352.48 | 240.12 | 484.58 | 421.71 | 294.49 | 444.1 |
| 705 | 207.17 | 248.23 | 356.25 | 239.24 | 483.52 | 422.77 | 295.04 | 446.75 |
| 720 | 209.36 | 248.5 | 361.06 | 239.34 | 487.52 | 426.01 | 291.35 | 448.88 |
| 735 | 211.28 | 248.55 | 365.19 | 240.78 | 490.82 | 421.29 | 296.57 | 449.19 |
| 750 | 213.43 | 248.78 | 370.05 | 241.46 | 490.38 | 424.47 | 301.94 | 450.89 |

FIG. 5

500

| Time Sec. | A. Exhaust (°F) | B. Liquid in Outer Sleeve (°F) | C. Superheated Steam Outlet (°F) | D. Outer Water Jacket (°F) | E. Upper Surface of Upper Sleeve (0 Deg. Rotation) (°F) | F. Upper Surface of Upper Sleeve (180 Deg. Rotation) (°F) | G. Upper Surface of Upper Sleeve (90 Deg. Rotation) (°F) | H. Midpoint of Upper Sleeve (about 180 Deg. Rotation) (°F) |
|---|---|---|---|---|---|---|---|---|
| 780 | 217.83 | 249.63 | 378.34 | 242.1 | 499.75 | 431.5 | 301.11 | 456.5 |
| 795 | 219.87 | 249.75 | 382.61 | 242.28 | 508.9 | 436.99 | 302.4 | 457.72 |
| 810 | 221.81 | 249.99 | 386.94 | 242.78 | 509.05 | 434.51 | 304.06 | 460.52 |
| 825 | 223.82 | 250.34 | 390.76 | 244.15 | 515.35 | 433.09 | 297.69 | 464.49 |
| 840 | 226.11 | 250.7 | 394.78 | 246.19 | 509.86 | 439.5 | 307.1 | 466.41 |
| 855 | 228.52 | 250.78 | 398.12 | 246.66 | 518.1 | 444.11 | 306.48 | 468.19 |
| 870 | 230.16 | 251.37 | 402.01 | 248.68 | 514.64 | 445.43 | 307.58 | 471.24 |
| 885 | 232.14 | 252.05 | 405.89 | 250.66 | 519.86 | 447.67 | 307.12 | 474.05 |
| 900 | 233.65 | 252.31 | 409.2 | 251.51 | 528.87 | 445.33 | 306.93 | 471.54 |
| 915 | 235.14 | 252.68 | 412.84 | 253.18 | 525.46 | 450.17 | 311.6 | 476.03 |
| 930 | 235.68 | 253.31 | 416.55 | 254.06 | 529.39 | 451.64 | 311.95 | 475.96 |
| 945 | 236.75 | 253.73 | 420.96 | 255.08 | 523.72 | 456.54 | 314.29 | 478.07 |
| 960 | 237.57 | 254.04 | 423.33 | 255.1 | 532.81 | 456.24 | 321.59 | 478.19 |
| 975 | 238.46 | 254.35 | 426.42 | 255.47 | 530.94 | 455.59 | 316.23 | 479.99 |
| 990 | 239.78 | 254.72 | 430.36 | 256.55 | 537.41 | 459.94 | 316.42 | 485.96 |
| 1005 | 241.01 | 255.2 | 433.6 | 257.7 | 539.62 | 463.34 | 326.32 | 474.27 |
| 1020 | 241.11 | 255.49 | 436.74 | 257.49 | 540.63 | 462.66 | 314.32 | 489.43 |
| 1035 | 240.72 | 255.78 | 440.06 | 258.6 | 536.06 | 462.82 | 325.34 | 483.4 |
| 1050 | 240.69 | 256.28 | 442.46 | 258.69 | 543.74 | 467.9 | 323.62 | 484.64 |
| 1065 | 240.43 | 256.47 | 445.84 | 258.88 | 543.25 | 468.37 | 325.67 | 485.8 |
| 1080 | 239.15 | 256.84 | 449.29 | 259.89 | 546.53 | 472.34 | 327.88 | 487.76 |
| 1095 | 238.13 | 257.4 | 451.93 | 261.24 | 546.89 | 470.45 | 327.79 | 493.11 |
| 1110 | 238.81 | 257.61 | 455.09 | 261.36 | 544.91 | 470.95 | 326.81 | 486.9 |
| 1125 | 239.65 | 257.42 | 457.52 | 262.01 | 548.06 | 474.15 | 333.97 | 486.73 |
| 1140 | 240.8 | 257.67 | 460.89 | 260.81 | 547.77 | 475.11 | 327.89 | 492.96 |
| 1155 | 241.42 | 258.33 | 463.61 | 263.16 | 550.45 | 475.25 | 322.13 | 497.49 |
| 1170 | 242.63 | 258.55 | 465.81 | 260.91 | 554.33 | 478.22 | 334.63 | 497.27 |
| 1185 | 243.8 | 258.72 | 469.22 | 263.86 | 549.72 | 481.16 | 332.09 | 496.99 |
| 1200 | 244.76 | 259.04 | 471.66 | 261.85 | 552.13 | 483.55 | 333.36 | 496.3 |
| 1300 | 252.32 | 260.43 | 488.68 | 262.64 | 561.5 | 492.97 | 407.91 | 509.28 |
| 1400 | 259.36 | 261.87 | 503.97 | 264.9 | 567.43 | 503.2 | 492.45 | 520.47 |
| 1500 | 265.84 | 262.92 | 518.12 | 259.68 | 575.69 | 513.68 | 500.8 | 531.32 |
| 1600 | 258.86 | 264.67 | 532.3 | 266.34 | 579.36 | 520.05 | 513.45 | 526.04 |
| 1700 | 266.53 | 265.7 | 543.33 | 271.72 | 580.55 | 528.08 | 515.49 | 526.47 |
| 1800 | 274.61 | 265.89 | 554.15 | 275.21 | 587.49 | 535.3 | 524.41 | 539.29 |
| 1900 | 273.97 | 266.49 | 564.17 | 325.13 | 594.51 | 541.72 | 535.93 | 551.11 |
| 2000 | 269.22 | 268.1 | 572.56 | 379.89 | 588.78 | 542.11 | 535.7 | 538.45 |
| 2100 | 274.41 | 268.44 | 580.07 | 388.17 | 591.7 | 548.7 | 540.36 | 541.85 |
| 2200 | 276.9 | 268.94 | 587.58 | 398.8 | 595.36 | 551.26 | 546.46 | 550.29 |
| 2300 | 275.75 | 269.62 | 593.56 | 406.82 | 593.79 | 555.5 | 549.03 | 548.34 |
| 2400 | 275.66 | 270.47 | 599.01 | 413.46 | 592.06 | 556.28 | 546.78 | 545.09 |
| 2500 | 279.7 | 270.6 | 603.66 | 417.7 | 593.4 | 558.1 | 551.96 | 550.09 |
| 2600 | 281.43 | 270.36 | 608.16 | 423.94 | 598.46 | 561.47 | 556.63 | 552.16 |
| 2700 | 281.45 | 271.17 | 612.79 | 428.45 | 598.93 | 567.16 | 558.11 | 553.04 |
| 2800 | 281.98 | 271.9 | 617.13 | 433.1 | 596.72 | 564.8 | 559.59 | 558 |
| 2900 | 281.69 | 271.98 | 620.73 | 436.09 | 597.89 | 568.84 | 558.68 | 555.34 |
| 3000 | 278.68 | 272.91 | 623.68 | 439.59 | 593.97 | 566.68 | 561.3 | 554.12 |
| 3100 | 281.85 | 272.84 | 626.04 | 443.05 | 596.65 | 570.5 | 562.88 | 553.17 |
| 3200 | 283.23 | 272.21 | 628.82 | 443.14 | 602.55 | 572.86 | 566.91 | 558.73 |
| 3300 | 279.84 | 272.86 | 631.6 | 441.57 | 599.07 | 570.9 | 564.38 | 553.75 |
| 3400 | 282.19 | 272.99 | 633.14 | 400.66 | 602.98 | 574.27 | 566.39 | 559.1 |
| 3500 | 285.05 | 272.74 | 635.12 | 447.77 | 603.84 | 580.77 | 571.29 | 564.16 |
| 3600 | 278.67 | 269.76 | 633.85 | 446.15 | 571.62 | 563.71 | 555.14 | 519.98 |

FIG. 5 (cont.)

SUPERHEATED STEAM BOILER AND METHOD FOR OPERATION THEREOF

CROSS-REFERENCE TO RELATED APPLICATION

This application is the National Phase Application of PCT International Application No. PCT/US18/35438, International Filing Date May 31, 2018, which claims the benefit of U.S. Provisional Application Ser. No. 62/515,350, filed on Jun. 5, 2017, entitled "Superheated Steam Boiler System,", each of which being incorporated herein by reference in its entirety.

TECHNICAL FIELD

This application is directed, in general, to a boiler, and more specifically, to a superheated steam boiler and method for operation thereof.

BACKGROUND

Superheated steam is a steam at a temperature higher than its vaporization (boiling) point at the absolute pressure where the temperature is measured. The steam can therefore cool (lose internal energy) by some amount, resulting in a lowering of its temperature without changing state (i.e., condensing) from a gas, to a mixture of saturated vapor and liquid. If unsaturated steam (a mixture which contain both water vapor and liquid water droplets) is heated at constant pressure, its temperature will also remain constant as the vapor quality increases towards 100%, and becomes dry (i.e., no saturated liquid) saturated steam. Continued heat input will then "super" heat the dry saturated steam. This will occur if saturated steam contacts a surface with a higher temperature.

To produce superheated steam in a power plant or for processes (such as drying paper) the saturated steam drawn from a boiler is passed through an entirely separate heating device (e.g., a superheater) which transfers additional heat to the steam by contact or by radiation. What is needed in the art is superheated steam boiler that provides all the benefits of existing steam boilers but is contained within a single unit.

SUMMARY

One aspect provides a superheated steam boiler. The superheated steam boiler, in this embodiment, includes an inner tank system, the inner tank system including a first wet tank and a second dry tank separated from one another by an isolation member, an outer sleeve at least partially surrounding the inner tank system, wherein one or more wet tank fluid openings proximate a lower surface of the first wet tank allow the first wet tank to be in fluid communication with the outer sleeve, and further wherein one or more dry tank steam openings in the second dry tank allow the second dry tank to be in steam communication with the outer sleeve, and a burner system located primarily within the inner tank system. The burner system, in this embodiment, includes a combustion/expansion chamber having one or more spherical surfaces located in and fluidly isolated from the first wet tank, a distribution chamber located in and fluidly isolated from the second dry tank, a plurality of heat tubes extending through the isolation member between the combustion/expansion chamber and the distribution chamber; and an exhaust tube extending from the distribution chamber and out of the inner tank system to exit the superheated steam boiler.

Further provided, in one embodiment, is a method for operating such a superheated steam boiler.

BRIEF DESCRIPTION

Reference is now made to the following descriptions taken in conjunction with the accompanying drawings, in which:

FIG. 5 illustrates a table providing data supporting the graph of FIG. 4.

DETAILED DESCRIPTION

Figure 1:
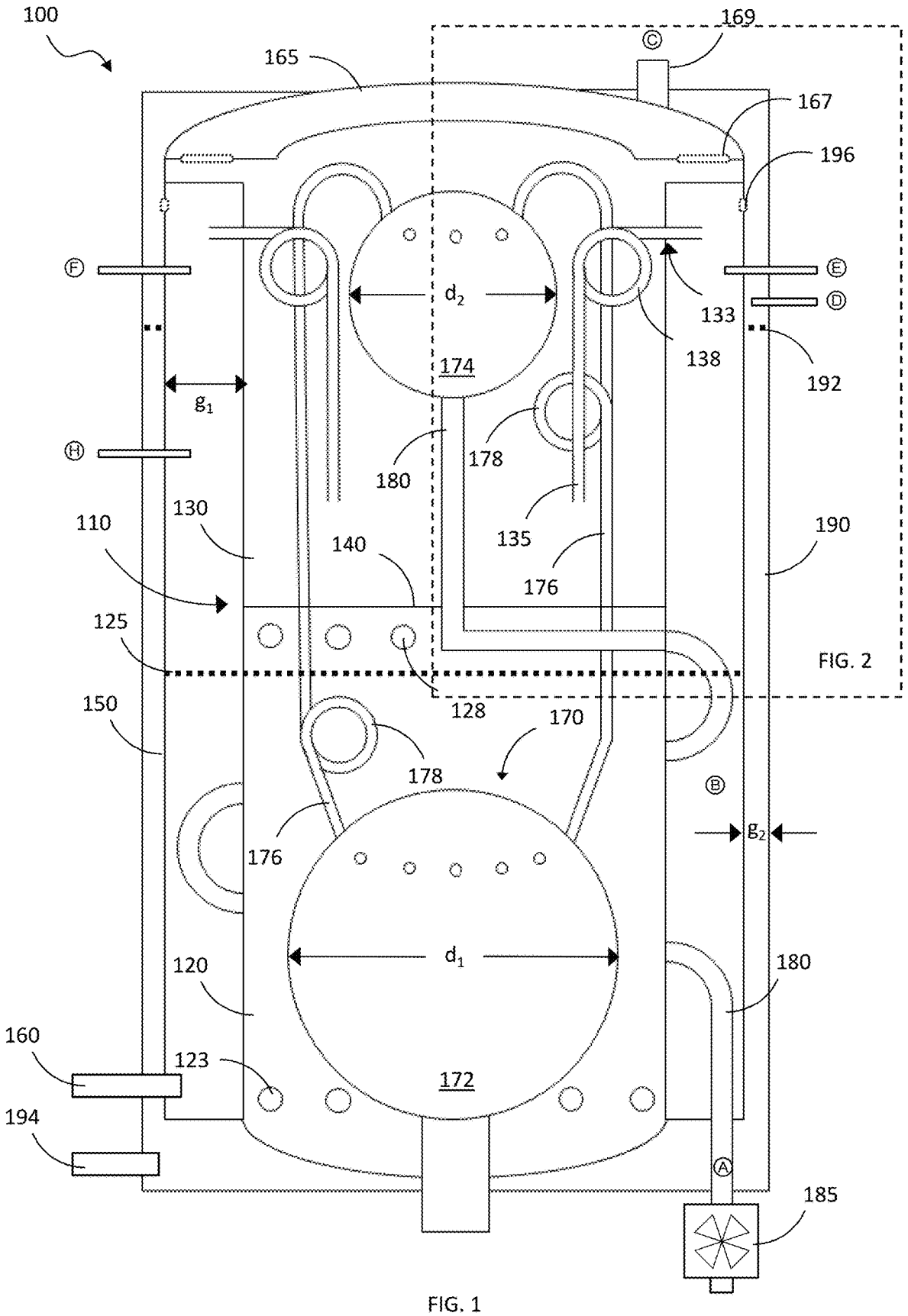
FIG. 1 illustrates one embodiment of a superheated steam boiler manufactured in accordance with the principles of the present disclosure.

Turning to FIG. 1, illustrated is one embodiment of a superheated steam boiler 100 manufactured in accordance with the principles of the present disclosure. The superheated steam boiler 100 of FIG. 1 includes an inner tank system 110. The inner tank system 110, in the disclosed embodiment, includes a first wet tank 120 and a second dry tank 130 separated from one another by an isolation member 140. The term "wet tank" as used herein, means that the tank is configured and/or adapted to receive and contain a liquid. The term "dry tank" as used herein, means that the tank is not configured and/or adapted to receive and contain a liquid, but in many embodiments is configured to receive and/or contain steam. Therefore, while a wet tank is ultimately coupled (e.g., either directly or indirectly) to a source of liquid, a dry tank has no such coupling.

Each of the first wet tank 120 and second dry tank 130 may be a simple enclosure, or alternatively may be a pressurized tank such as a pressure vessel. The first wet tank 120 and second dry tank 130 may take on a variety of different materials and shapes and remain within the purview of the disclosure. In the illustrated embodiment of FIG. 1, however, the first wet tank 120 and second dry tank 130 each comprise a stainless steel cylindrical pressure vessel. Separating the first wet tank 120 and second dry tank 130 is the isolation member 140. The isolation member 140, in accordance with one embodiment of the disclosure, fully isolates any fluid or gas transfer directly between the first wet tank 120 and second dry tank 130. Notwithstanding, in one embodiment, the isolation member 140 comprises a conductive material, and thus allows direct transfer of heat between the first wet tank 120 and second dry tank 130. While many different materials may be used for the isolation member 140, one particular embodiment uses a stainless steel isolation member 140.

The superheated steam boiler 100 illustrated in FIG. 1 further includes an outer sleeve 150 at least partially surrounding the inner tank system 110. The term "partially surrounding," as used with respect to the outer sleeve 150, means that the outer sleeve surrounds at least 50 percent of the surface area of the inner tank system 110. In yet another embodiment, the outer sleeve substantially surrounds (e.g., surrounds at least 75 percent of the surface area of the inner tank system 110) or entirely surrounds (e.g., surrounds 100 percent of the surface area of the inner tank system 110) the inner tank system 110.

The outer sleeve 150, in accordance with the disclosure, is configured as a "wet tank", and thus is configured and/or adapted to receive and contain a liquid within a gap ($g_1$) between the inner tank system 110 and the outer sleeve 150. In fact, in the embodiment of FIG. 1, a liquid source 160 is coupled directly to the outer sleeve 150. Moreover, in the embodiment of FIG. 1, one or more wet tank fluid openings 123 proximate a lower surface of the first wet tank 120 allow the first wet tank 120 to be in fluid communication with the outer sleeve 150. Accordingly, in the embodiment of FIG. 1, the outer sleeve 150 may receive an amount of first liquid 125 from the liquid source 160, while the first liquid 125 is transferred directly to the first wet tank 120 via the one or more wet tank fluid openings 123. In such an embodiment, a level of the first liquid 125 within the first wet tank 120 and the outer sleeve 150 may be the same. While FIG. 1 has been discussed as having one or more wet tank fluid openings 123, certain embodiments exist wherein four or more wet tank fluid openings 123 fluidly connect the outer sleeve 150 to the first wet tank 120.

In the embodiment of FIG. 1, the first wet tank 120 additionally has one or more wet tank steam openings 128 proximate an upper surface thereof. The wet tank steam openings 128, which in certain embodiment include four or more wet tank steam openings 128, should be located above the level of the first liquid 125. Stated another way, when filling the first wet tank 120 and the outer sleeve 150 with liquid, it is preferred that the level of the first liquid 125 be below the one or more wet tank steam openings 128. As will be understood more fully below, the wet tank steam openings 128 allow steam that forms within the first wet tank 120 to travel to the outer sleeve 150.

In addition to the one or more wet tank fluid openings 123 and wet tank steam openings 128 coupling the first wet tank 120 and the outer sleeve 150, one or more dry tank steam openings 133 may exist within the second dry tank 130 to allow steam to communicate between the outer sleeve 150 and the second dry tank 130. As will be more fully understood below, during operation the steam tends to travel from the outer sleeve 150 through the dry tank steam openings 133 to the second dry tank 130. Similar to above, certain embodiments employ four or more dry tank steam openings 133, and even ten or more dry tank steam openings 133, but the number may vary according to the design of the superheated steam boiler 100.

In one embodiment, one or more steam tubes 135 are positioned in the one or more dry tank steam openings 133 to allow the outer sleeve 150 to be in steam communication with the second dry tank 130. While not absolutely necessary, the one or more steam tubes 135 could have a conductive nature, such as if they were manufactured from stainless steel. Other embodiments may exist wherein the one or more steam tubes 135 are not conductive in nature.

The number of the one or more steam tubes 135 may vary according to different embodiments of the disclosure. In one embodiment, four or more steam tubes 135 extend between the outer sleeve 150 and the second dry tank 130. In yet another embodiment, eight or more steam tubes 135 extend between the outer sleeve 150 and the second dry tank 130. In the particular embodiment of FIG. 1, which is a representation of a superheated steam boiler system that has actually been manufactured and tested, ten steam tubes 135 extend between the outer sleeve 150 and the second dry tank 130.

In certain embodiments, the one or more steam tubes 135 have steam loops 138 therein, the steam loops 138 positioned within the interior of the second dry tank 130. Not every steam tube 135 must have a steal loop 138. Accordingly, in one embodiment, such as the embodiment of FIG. 1, each of the ten steam tubes 135 has its own steam loop 138. Other configurations are, however, within the scope of the disclosure.

The gap ($g_1$) between the outer sleeve 150 and the inner tank system 110 may vary depending on the general design requirements of the system. In the embodiment of FIG. 1, which is a representation of a superheated steam boiler system that has actually been manufactured and tested, the gap ($g_1$) is about 75 mm. Notwithstanding, the gap ($g_1$) should not be limited to any specific value, and thus other values are within the purview of the disclosure.

The superheated steam boiler 100, in one embodiment, may further include a lid 165 attached proximate a top surface of the second dry tank 130. The lid 165, in one embodiment, is a double walled lid. The lid 165, in accordance with this embodiment, may have one or more lid openings 167 allowing an interior of the lid 165 to be in steam communication with the second dry tank 130. The lid 165 may further include a steam outlet 169 allowing steam generated from the superheated steam boiler 100 to be collected.

The superheated steam boiler 100 of FIG. 1 further includes a burner system 170 primarily located within the inner tank system 100. The term "primarily" as used with regard to the burner system 170, means that a majority of the key features of the burner system 170 are located within either the first wet tank 120 or the second dry tank 130, but other features such as the exhaust features may be located outside of the first wet tank 120 or second dry tank 130.

The burner system 170 of FIG. 1 initially includes a combustion/expansion chamber 172 located within the first wet tank 120. In accordance with the disclosure, the combustion/expansion chamber 172 has one or more spherical surfaces and is fluidly isolated from the first wet tank 120. As discussed above, the first wet tank 120 may (e.g., will during operation) have fluid therein, and the combustion/expansion chamber 172 should be isolated from this fluid.

The combustion/expansion chamber 172 may comprise a variety of different shapes, sizes and materials and remain within the purview of the disclosure, but it may have at least one spherical surface. In one embodiment, the combustion/expansion chamber 172 is a spherocylinder (e.g., is pill shaped), and thus has two spherical surfaces that vertically face one another. In yet another embodiment, such as shown in FIG. 1, the combustion/expansion chamber 172 comprises a sphere (e.g., semi-perfect sphere or perfect sphere).

The size of the combustion/expansion chamber 172 may vary according to the design of the superheated steam boiler 100. Notwithstanding, in the embodiment of FIG. 1, which is again a representation of a superheated steam boiler system that has actually been manufactured and tested, the combustion/expansion chamber 172 is a sphere having about a 300 mm diameter ($d_1$). Again, other diameters ($d_1$) are within the purview of the disclosure, and thus may be used.

It is important that the combustion/expansion chamber 172 be able to conduct heat to the surrounding liquid in the first wet tank 120. Accordingly, the combustion/expansion chamber 172 should have a conductive nature. While just about any conductive material may be used for the combustion/expansion chamber 172, one embodiment of the disclosure uses a stainless steel sphere.

The burner system 170 of FIG. 1 further includes a distribution chamber 174 located within the second dry tank 130. As discussed above, the second dry tank may (e.g., will during operation) have steam therein, and the distribution chamber 174 should be isolated from this steam. The distribution chamber 174 may comprise a variety of different shapes, sizes and materials and remain within the purview of the disclosure. Similar to the combustion/expansion chamber 172, the distribution chamber 174 may have at least one spherical surface. In one embodiment, the distribution chamber 174 is a spherocylinder, and thus has two spherical surfaces that face one another. In yet another embodiment, such as shown in FIG. 1, the distribution chamber 174 comprises a sphere (e.g., semi-perfect sphere or perfect sphere).

The size of the distribution chamber 174 may vary according to the design of the superheated steam boiler 100. Notwithstanding, in the embodiment of FIG. 1, which is again a representation of a superheated steam boiler system that has actually been manufactured and tested, the distribution chamber 174 is a sphere having about a 225 mm diameter ($d_2$). Again, other diameters ($d_2$) are within the purview of the disclosure, and thus may be used.

It is important that the distribution chamber 174 be able to conduct heat to the surrounding steam in the second dry tank 130. Accordingly, the distribution chamber 174, much like the combustion/expansion chamber 172, should have a conductive nature. While just about any conductive material may be used for the distribution chamber 174, one embodiment of the disclosure uses a stainless steel sphere.

The burner system 170 according to the disclosure further includes a plurality of heat tubes 176 extending through the isolation member 140 between the combustion/expansion chamber 172 and the distribution chamber 174. The plurality of heat tubes 176, in the embodiment of FIG. 1, are configured to transfer heat from the combustion/expansion chamber 172 to the distribution chamber 174, but at the same time transfer heat to the first fluid 125 located within the first wet tank 120 and the air and/or steam located within the second dry tank 130. Accordingly, the plurality of heat tubes 176 should have a conductive nature, such as if they were manufactured from stainless steel.

The number of heat tubes 176 may vary according to different embodiments of the disclosure. In one embodiment, four or more heat tubes 176 extend between the combustion/expansion chamber 172 and the distribution chamber 174. In yet another embodiment, eight or more heat tubes 176 extend between the combustion/expansion chamber 172 and the distribution chamber 174. In the particular embodiment of FIG. 1, which is again a representation of a superheated steam boiler system that has actually been manufactured and tested, ten heat tubes 176 extend between the combustion/expansion chamber 172 and the distribution chamber 174.

The heat tubes 176, in accordance with one embodiment, may include heat distribution loops 178 therein. The heat distribution loops 178, when used, create more surface area for the heat tubes 176 to transfer heat to the liquid in the first wet tank 120 and the air and/or steam in the second dry tank 130. Accordingly, in certain embodiments the heat distribution loops 178 are contained within the first wet tank 120, in other embodiments the heat distribution loops 178 are contained within the second dry tank 130, and yet in even different embodiments the heat distribution loops 178 are contained within both the first wet tank 120 and the second dry tank 130. Notwithstanding, in the embodiment of FIG. 1, ones of the heat tubes 176 have heat distribution loops 178 therein positioned in the first wet tank 120 and other ones of the heat tubes 176 have heat distribution loops 178 therein positioned in the second dry tank 130. Thus, in the embodiment of FIG. 1, which is again a representation of a superheated steam boiler system that has actually been manufactured and tested, six of the heat tubes 176 have heat distribution loops 178 positioned in the first wet tank 120 and the other four heat tubes 176 have heat distribution loops 178 positioned in the second dry tank 130.

While not required, certain embodiments employ a similar number of steam tubes 135 coupling the outer sleeve 150 and the second dry tank 130 as heat tubes 176 coupling the combustion/expansion chamber 172 and the distribution chamber 174. Other embodiments exist wherein the number of steam tubes 135 and heat tubes 176 differ. Similarly, while again not required, certain embodiments employ a similar number of steam loops 138 coupling the outer sleeve 150 and the second dry tank 130 as heat distribution loops 178 coupling the combustion/expansion chamber 172 and the distribution chamber 174. Other embodiments exist wherein the number of steam loops 138 and heat distribution loops 178 differ.

The burner system 170 illustrated in FIG. 1, further includes an exhaust tube 180 extending from the distribution chamber 174 and out of the inner tank system 110 to exit the superheated steam boiler 100. The exhaust tube 180 may take a variety of different paths to leave the superheated steam boiler 100. In one embodiment, however, the exhaust tube 180 extends from the distribution chamber 174 through the isolation member 140 and into the first wet tank 120. In this embodiment, the exhaust tube 180 then exits out of the first wet tank 120 into the outer sleeve 150, wherein it then bends around within the outer sleeve 150 and exits the superheated steam boiler 100.

In one embodiment, an inducted draft device 185 may be employed to assist any exhaust from exiting the superheated steam boiler 100 via the exhaust tube 180. The induced draft device 185 may comprise any device capable of drawing the exhaust from the superheated steam boiler. In one embodiment, however, the inducted draft device 185 is a standard linear or centrifugal fan.

The superheated steam boiler 100, according to the disclosure, may additionally include an outer water jacket 190 substantially surrounding the outer sleeve 150. The term "substantially surrounding," as used with respect to the outer water jacket 190, means that the outer water jacket 190 surrounds at least 75 percent of the surface area of the outer sleeve 150. The outer water jacket 190, in accordance with the disclosure, is configured as a "wet tank", and thus is configured and/or adapted to receive and contain a second liquid 192 within a gap ($g_2$) between the outer sleeve 150 and the outer water jacket 190. In fact, in the embodiment of FIG. 1, a liquid source 194 is coupled directly to the outer water jacket 190 to provide the second liquid 192.

In the embodiment of FIG. 1, the outer sleeve 150 has one or more outer sleeve steam openings 196 proximate an upper surface thereof. The outer sleeve steam openings 196, in this embodiment, provide steam communication from the outer water jacket 190 to the outer sleeve 150. The outer sleeve steam openings 196, which in certain embodiment include four or more outer sleeve steam openings 196, should be located above the level of the second liquid 192. Stated another way, when filling the outer water jacket 190, it is preferred that the level of the second liquid 192 be below the one or more outer sleeve steam openings 196. As will be understood more fully below, the outer sleeve steam openings 196 allow any steam that forms within the outer water jacket 190 to travel to the outer sleeve 150.

The outer water jacket 190, when used, assists in the transfer of any heat generated by the burner system 170 to the superheated steam exiting the superheated steam boiler 100. For instance, the outer water jacket 190 has shown helpful in reducing the difference in temperature between the first liquid 125 in the first wet tank 120 and the outer sleeve 150, and the temperature of the exhaust exiting the exhaust tube 180. In fact, the use of the outer water jacket 190 has reduced the difference in temperature by 10 degrees or more. Accordingly, the outer water jacket 190 helps with the efficiency of the superheated steam boiler 100.

Figure 2:
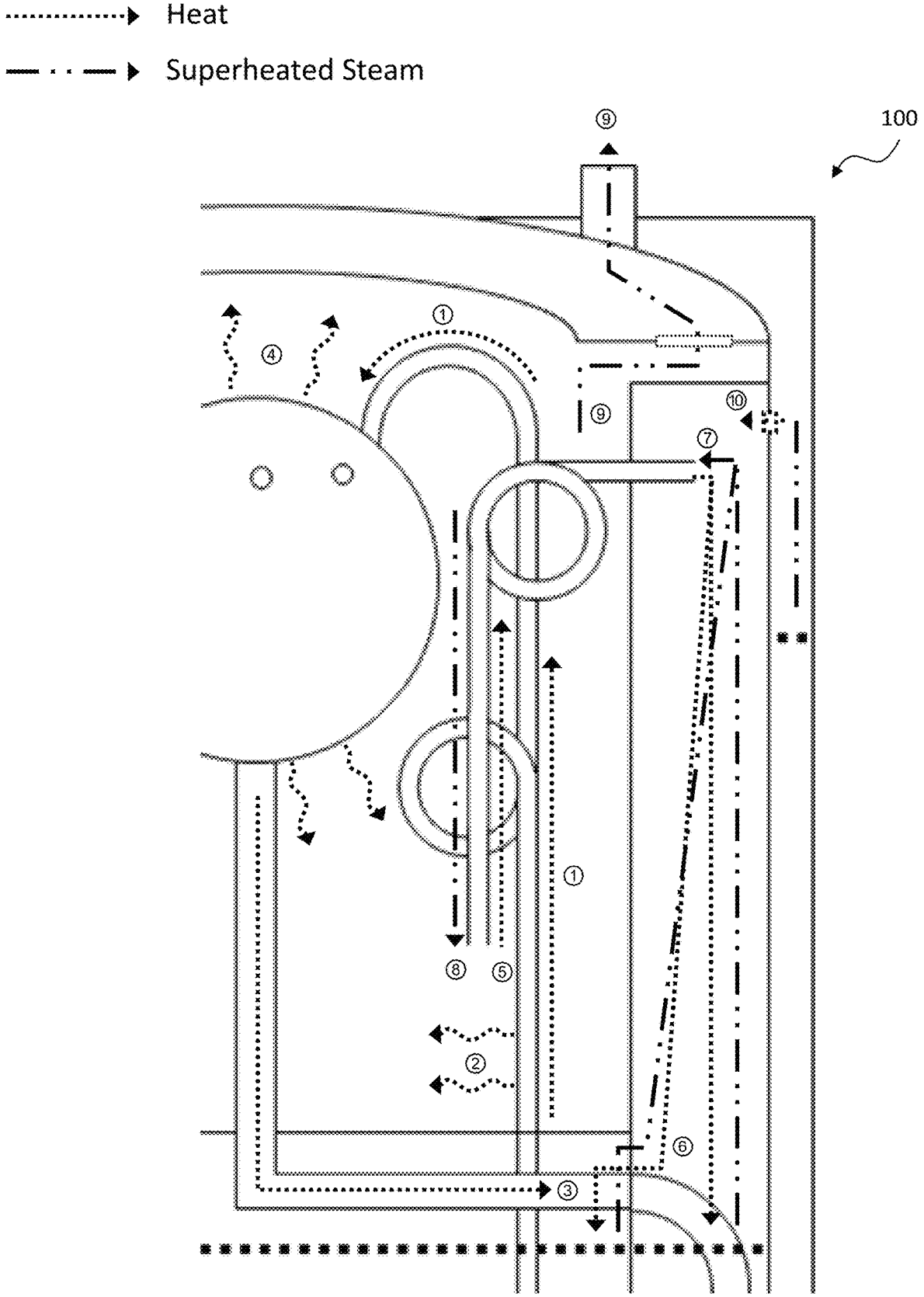
FIG. 2 illustrates a zoomed in portion of the upper right hand side of the superheated steam boiler of FIG. 1.

Turning now to FIG. 2, illustrated is zoomed in portion of the upper right hand side of the superheated steam boiler 100 of FIG. 1. FIG. 2 is used to illustrate the flow path of the heat (e.g., as depicted with the dotted line) and the flow path of the superheated steam (e.g., as depicted with the semi-dashed line).

In terms of the heat, the heat initially travels up the plurality of heat tubes 176 toward the distribution chamber 174, as illustrated by the dotted lines ①, but also radiates from the plurality of heat tubes 176, as illustrated by the dotted lines ②. The same heat not only travels out the exhaust tube 180, as illustrated by the dotted lines ③, but also radiates from the distribution chamber 174, as shown by the dotted lines ④. Accordingly, excess heat collects in the second dry tank 130, and through typical heat transfer mechanisms (e.g., looking for a place to transfer itself) travels up the steam tube 135, as shown by dotted lines ⑤, and impinges upon the first liquid 125 within the outer chamber 150, as well as impinges upon the first liquid 125 within the first wet tank 120 via the wet tank steam openings 128, as shown by dotted line ⑥. The heat impinging down upon the first liquid 125, as shown by dotted line ⑥, is believed to be in the form of a concentrated jet stream of heat. This seems to be substantiated when three similar height but circumferentially offset temperature sensors were placed within the outer chamber 150. The temperature sensor that was placed closest in proximity to the path of the jet stream formed between the steam tube 135 and the wet tank steam opening 128 had a significantly higher temperature reading than an equal height temperature sensor that was placed further away from the jet stream formed between the steam tube 135 and the wet tank steam opening 128. As the outlets of the steam tubes 135 and the wet tank steam openings 128 were circumferentially offset from one another, the jet stream phenomenon was easier to observe. The first liquid 125 continues to increase in temperature until it reaches its boiling point, for example because of the heat impinging down upon the first liquid 125, as shown by dotted line ⑥, as well as other heat in the system.

Once the first liquid 125 reaches its boiling point, steam begins to form at the surface of the first liquid 125. The first liquid in the first wet tank tends to reach its boiling point prior to the first liquid 125 in the outer sleeve 150. It is believed that when there becomes a sustainable superheated condition above its vaporization point at the absolute pressure where the temperature is measured, the superheated steam acts as a shunt partially breaking this naturally occurring attraction of heat to the first liquid, which then allows this heat to then be applied to the superheated steam raising its temperature. Accordingly, superheated steam forms, as shown by the semi-dashed line ⑦, which initially comes from the first wet tank 120 and subsequently also comes from the outer sleeve 150. The superheated steam travels back through the steam tube 135, as shown by the semi-dashed line ⑧. In fact, it is also believed that while the heat travels through the steam tube 135 in one direction toward the first liquid 125, as shown by the dotted line ⑤, the superheated steam travels through the steam tube 135 in the opposite direction, as shown by the semi-dashed line ⑧. The superheated steam exits the steam tube 135 and rises within the second dry tank 130 until it reaches the one or more lid openings 167 in the lid 165, at which time it enters the lid 165 and exits the steam outlet 169, as shown by the semi-dashed line ⑨.

When the outer water jacket 190 is in use, superheated steam from the second liquid 192 may exit the outer sleeve steam opening 196 and enter the outer sleeve 150, as shown by the semi-dashed line ⑩. The superheated steam from the outer water jacket 190, as shown by the semi-dashed line ⑩, may then combine with the superheated steam from the outer sleeve, as shown by the semi-dashed line ⑦, and then enter the steam tube 135 as combined superheated steam, as shown by the semi-dashed line ⑧.

Figure 3:
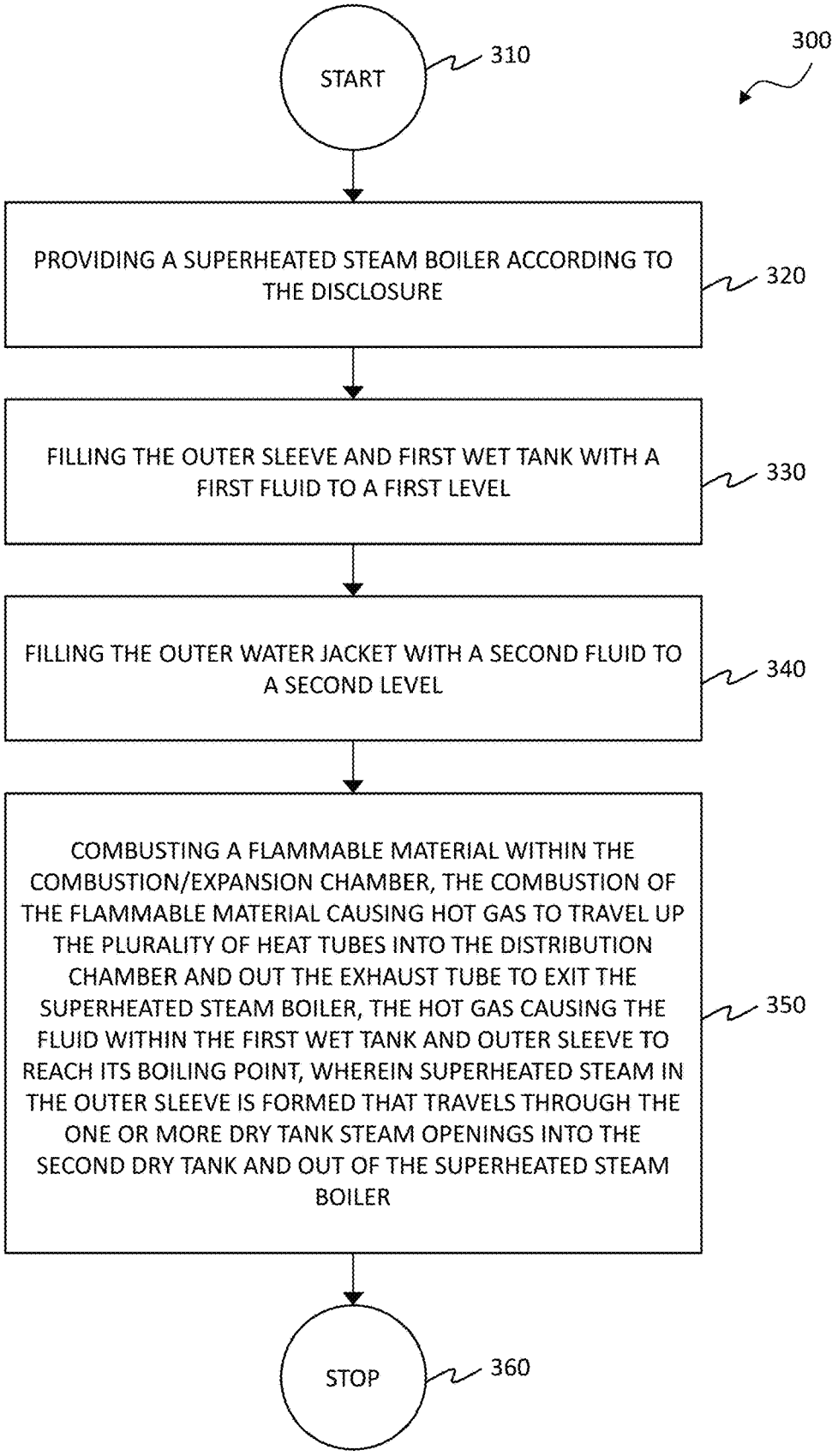
FIG. 3 illustrates a flow diagram illustrating one embodiment for a method for operating a superheated steam boiler in accordance with the disclosure.

Turning to FIG. 3, illustrated is a flow diagram 300 illustrating one embodiment for a method for operating a superheated steam boiler in accordance with the disclosure. The method begins in a start step 310. Thereafter, in a step 320, a superheated steam boiler is provided. The superheated steam boiler, in accordance with this embodiment, may be similar to the superheated steam boiler 100 illustrated and discussed with regard to FIG. 1. Notwithstanding, the superheated steam boiler provided in step 320 need not be that identical superheated steam boiler, but may be any superheated steam boiler manufactured in accordance with this disclosure. After the superheated steam boiler is provided, in a step 330, the outer sleeve may be filled with a first liquid to a first level. The liquid, in this embodiment, is tap water, or in another embodiment distilled water. Notwithstanding, other liquids are within the purview of the disclosure.

In an optional step 340, the outer water jacket may be filled with a second liquid to a second level. In one embodiment, the first liquid and the second liquid are similar liquids. In yet another embodiment, the first liquid and the second liquid are different liquids. While this is an optional step, significant advantages may be found when using the outer water jacket. Additionally, while the outer water jacket is described as being filled with the second fluid after the outer sleeve is filled with the first liquid, those skilled in the art appreciate that the reverse could be true, or alternatively they could be filled at substantially the same time.

With the outer sleeve having the first fluid therein, in a step 350, a flammable material is combusted within the combustion/expansion chamber. As those skilled in the art appreciate, as well as is discussed above with regard to FIG. 2, this causes hot gas to travel up the plurality of heat tubes into the distribution chamber and out the exhaust tube to exit the superheated steam boiler. The hot gas, in this example, provides heat to the first liquid in the first wet tank, as well as heat to the distribution chamber, which similarly transfers the heat to the second dry tank. Accordingly, the hot gas causes the first fluid within the first wet tank and outer sleeve to reach its boiling point, wherein superheated steam in the outer sleeve is formed that travels through the one or more dry tank steam openings into the second dry tank and out of the superheated steam boiler. The process would stop in a step 360, for example once an appropriate amount of superheated steam was collected from the superheated steam boiler.

Figure 4:
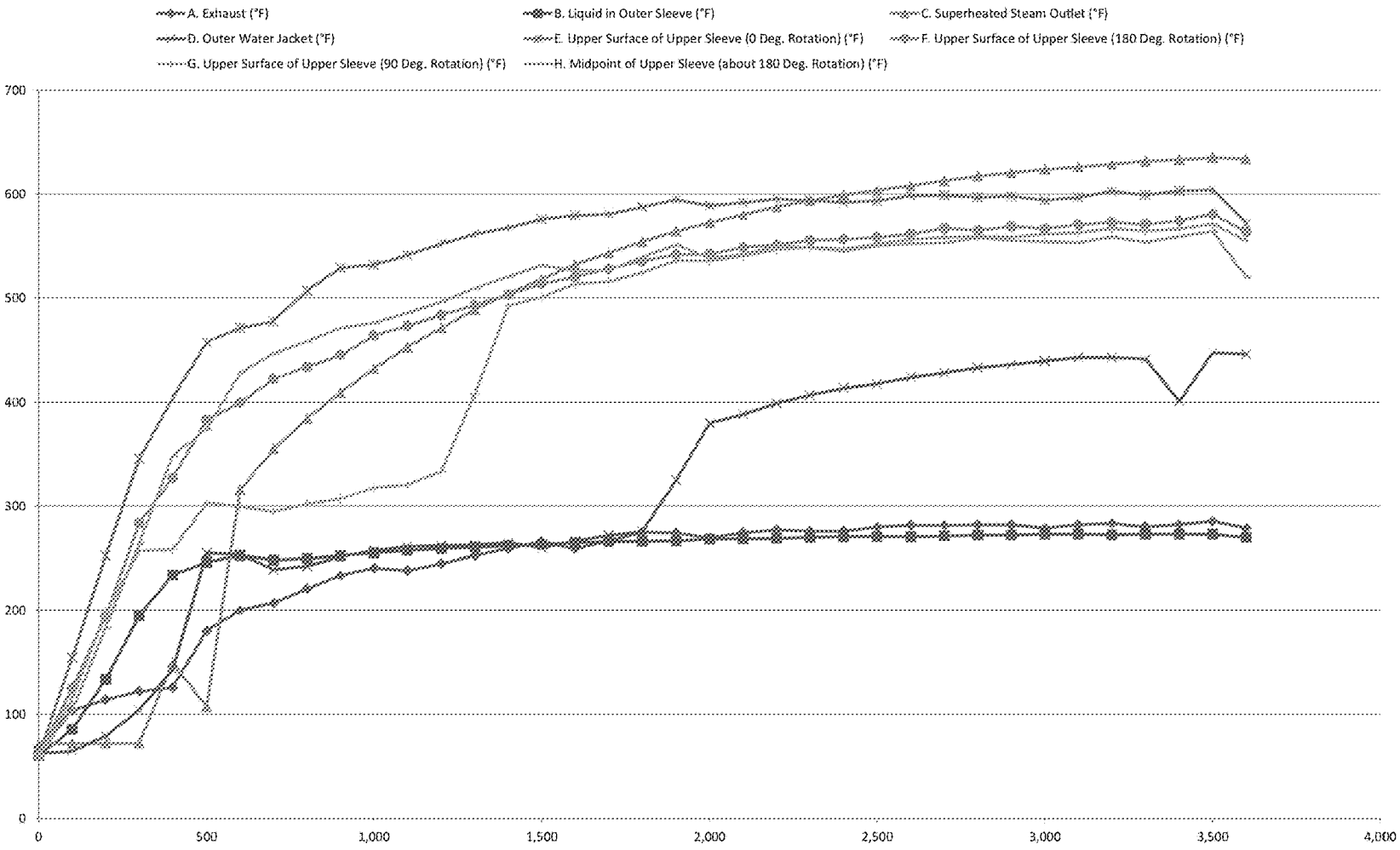
FIG. 4 illustrates a graph plotting temperature versus time at five different locations during one example test performed on a device similar to the superheated steam boiler illustrated in FIG. 1.

Turning to FIG. 4, illustrated is a graph 400 plotting temperature versus time at five different locations during one example test performed on a device similar to the superheated steam boiler illustrated in FIG. 1. With reference to FIG. 1, location Ⓐ is proximate the exhaust port 185, location Ⓑ is in the first liquid in the outer sleeve 150, location Ⓒ is proximate the superheated steam outlet 169, location Ⓓ is proximate an upper portion of the outer water jacket 190, location Ⓔ is proximate an upper surface of the outer sleeve 150, location Ⓕ is also proximate an upper surface of the outer sleeve 150 (e.g., at a substantially similar height as Ⓔ) but circumferentially offset by about 180 degrees from location Ⓔ, location Ⓖ is also proximate an upper surface of the outer sleeve 150 (e.g., at a substantially similar height as Ⓔ and Ⓕ) but circumferentially about equidistance between Ⓔ and Ⓕ, and location Ⓗ is below (e.g., directly or otherwise) location Ⓕ.

As is illustrated in the graph 400, at time zero, each of the temperature readings is substantially the same, for example at ambient temperature. As time elapses, and a flammable material is combusted within the combustion/expansion chamber, the temperatures at locations Ⓐ, Ⓑ, and Ⓔ begin to rise rapidly. In contrast, the temperatures at locations Ⓒ and Ⓓ rise at a much slower rate. In fact, it takes approximately 2 minutes for the temperatures at locations Ⓒ and Ⓓ to rise at all, and actually takes approximately 5 minutes before the temperature at location Ⓒ (e.g., the temperature at the superheated steam outlet 169) increases measurably. However, at the moment that location Ⓑ (e.g., the temperature of the first liquid 125) reaches the boiling point thereof, the temperature at location Ⓒ rises rapidly. At this same point in time (e.g., at approximately 5 minutes), the temperature at locations Ⓐ (e.g., the temperature at the exhaust port 180) and Ⓑ (e.g., temperature of the first liquid) substantially level off. In fact, at this point in time, and for the remainder of the test, the temperature at location Ⓐ (e.g., the temperature at the exhaust port 180) is only about 10 to 15 degrees higher than the temperature at location Ⓑ (e.g., temperature of the first liquid). This small difference in temperature illustrates the tremendous efficiency of the superheated steam boiler being tested, which is similar in form to the superheated steam boiler illustrated in FIG. 1.

Turning briefly to FIG. 5, illustrated is a table 500 providing data supporting the graph 400 plotting temperature versus time at five different locations during one example test performed on a device similar to the superheated steam boiler illustrated in FIG. 1.

Aspects disclosed herein include:

A. A superheated steam boiler, the superheated steam boiler including an inner tank system, the inner tank system including a first wet tank and a second dry tank separated from one another by an isolation member, an outer sleeve at least partially surrounding the inner tank system, wherein one or more wet tank fluid openings proximate a lower surface of the first wet tank allow the first wet tank to be in fluid communication with the outer sleeve, and further wherein one or more dry tank steam openings in the second dry tank allow the second dry tank to be in steam communication with the outer sleeve, a burner system located primarily within the inner tank system, wherein the burner system includes a combustion/expansion chamber having one or more spherical surfaces located in and fluidly isolated from the first wet tank, a distribution chamber located in and fluidly isolated from the second dry tank, a plurality of heat tubes extending through the isolation member between the combustion/expansion chamber and the distribution chamber, and an exhaust tube extending from the distribution chamber and out of the inner tank system to exit the superheated steam boiler.

B. A method for operating a superheated steam boiler, the method including providing a superheated steam boiler, the superheated steam boiler including, an inner tank system, the inner tank system including a first wet tank and a second dry tank separated from one another by an isolation member, an outer sleeve at least partially surrounding the inner tank system, wherein one or more wet tank fluid openings proximate a lower surface of the first wet tank allow the first wet tank to be in fluid communication with the outer sleeve, and further wherein one or more dry tank steam openings in the second dry tank allow the second dry tank to be in steam communication with the outer sleeve, a burner system located primarily within the inner tank system, the burner system including a combustion/expansion chamber having one or more spherical surfaces located in and fluidly isolated from the first wet tank, a distribution chamber located in and fluidly isolated from the second dry tank, a plurality of heat tubes extending through the isolation member between the combustion/expansion chamber and the distribution chamber, and an exhaust tube extending from the distribution chamber and out of the inner tank system to exit the superheated steam boiler, the method further including filling the outer sleeve and first wet tank with a fluid to a first level, and combusting a flammable material within the combustion/expansion chamber, the combustion of the flammable material causing hot gas to travel up the plurality of heat tubes into the distribution chamber and out the exhaust tube to exit the superheated steam boiler, the hot gas causing the fluid within the first wet tank and outer sleeve to reach its boiling point, wherein superheated steam in the first wet tank and outer sleeve is formed that travels through the one or more dry tank steam openings into the second dry tank and out of the superheated steam boiler.

Aspects A and B may have one or more of the following additional elements in combination:

Element 1: wherein four or more heat tubes extend through the isolation member between the combustion/expansion chamber and the distribution chamber. Element 2: wherein ones of the four or more heat tubes have heat distribution loops therein. Element 3: wherein ones of the four or more heat tubes have heat distribution loops therein positioned in the first wet tank and other ones of the four or more heat tubes have heat distribution loops therein positioned in the second dry tank. Element 4: further including one or more steam tubes positioned in the one or more dry tank steam openings in the second dry tank to allow the second dry tank to be in steam communication with the outer sleeve. Element 6: wherein ones of the one or more steam tubes have steam loops therein positioned in the second dry tank. Element 7: wherein the number of steam tubes equals the number of heat tubes. Element 8: further including one or more wet tank steam openings proximate an upper surface of the first wet tank to allow the first wet tank to be in steam communication with the outer sleeve. Element 9: wherein the first wet tank has four or more wet tank steam openings proximate the upper surface of the first wet tank and four or more dry tank steam openings proximate the upper surface of the second dry tank. Element 10: wherein the combustion/expansion chamber is a sphere. Element 11: wherein the exhaust tube extends from the distribution chamber through the isolation member into the first wet tank and then out of the first wet tank into the outer sleeve, wherein it then bends around within the outer sleeve and exits the superheated steam boiler. Element 12: further including a double walled lid attached proximate a top surface of the second dry tank, the lid having one or more lid openings allowing an interior of the lid to be in steam communication with the second dry tank and a steam outlet allowing steam generated from the superheated steam boiler to be collected. Element 13: further including an outer water jacket substantially surrounding the outer sleeve. Element 14: wherein the outer sleeve has one or more outer sleeve steam openings proximate an upper surface thereof. Element 15: further including an inducted draft device coupled to the exhaust tube to assist any exhaust from exiting the superheated steam boiler. Element 16: wherein four or more heat tubes extend through the isolation member between the combustion/expansion chamber and the distribution chamber, and further wherein the combustion of the flammable material causes hot gas to travel up the four or more heat tubes and into the distribution chamber. Element 17: wherein ones of the four or more heat tubes have heat distribution loops therein, and further wherein the combustion of the flammable material causes hot gas to travel up the ones of the four or more heat tubes having heat distribution loops therein and into the distribution chamber. Element 18: wherein ones of the four or more heat tubes have heat distribution loops therein positioned in the first wet tank and other ones of the four or more heat tubes have heat distribution loops therein positioned in the second dry tank. Element 19: wherein the superheated steam in the outer sleeve travels through one or more steam tubes positioned in the one or more dry tank steam openings and into the second dry tank and out of the superheated steam boiler. Element 20: wherein ones of the one or more steam tubes have steam loops therein positioned in the second dry tank. Element 21: wherein the number of steam tubes equals the number of heat tubes. Element 22: further including one or more wet tank steam openings proximate an upper surface of the first wet tank to allow the first wet tank to be in steam communication with the outer sleeve.

Those skilled in the art to which this application relates will appreciate that other and further additions, deletions, substitutions and modifications may be made to the described embodiments.

What is claimed is:

1. A superheated steam boiler, comprising:

an inner tank system, the inner tank system including a first wet tank and a second dry tank separated from one another by an isolation member;

an outer sleeve at least partially surrounding the inner tank system, wherein one or more wet tank fluid openings proximate a lower surface of the first wet tank allow the first wet tank to be in fluid communication with the outer sleeve, and further wherein one or more dry tank steam openings in the second dry tank allow the second dry tank to be in steam communication with the outer sleeve;

a burner system located primarily within the inner tank system, the burner system including:

a combustion/expansion chamber having one or more spherical surfaces located in and fluidly isolated from the first wet tank;

a distribution chamber located in and fluidly isolated from the second dry tank;

a plurality of heat tubes extending through the isolation member between the combustion/expansion chamber and the distribution chamber; and an exhaust tube extending from the distribution chamber and out of the inner tank system to exit the superheated steam boiler.

2. The superheated steam boiler of claim 1, wherein four or more heat tubes extend through the isolation member between the combustion/expansion chamber and the distribution chamber.

3. The superheated steam boiler of claim 2, wherein one or more of the four or more heat tubes have heat distribution loops therein.

4. The superheated steam boiler of claim 3, wherein one or more of the four or more heat tubes have heat distribution loops therein positioned in the first wet tank and other ones of the four or more heat tubes have heat distribution loops therein positioned in the second dry tank.

5. The superheated steam boiler of claim 1, further including one or more steam tubes positioned in the one or more dry tank steam openings in the second dry tank to allow the second dry tank to be in steam communication with the outer sleeve.

6. The superheated steam boiler of claim 5, wherein one or more of the one or more steam tubes have steam loops therein positioned in the second dry tank.

7. The superheated steam boiler of claim 6, wherein the number of steam tubes equals the number of heat tubes.

8. The superheated steam boiler of claim 1, further including one or more wet tank steam openings proximate an upper surface of the first wet tank to allow the first wet tank to be in steam communication with the outer sleeve.

9. The superheated steam boiler of claim 8, wherein the first wet tank has four or more wet tank steam openings proximate the upper surface of the first wet tank and four or more dry tank steam openings proximate the upper surface of the second dry tank.

10. The superheated steam boiler of claim 1, wherein the combustion/expansion chamber is a sphere.

11. The superheated steam boiler of claim 1, wherein the exhaust tube extends from the distribution chamber through the isolation member into the first wet tank and then out of the first wet tank into the outer sleeve, wherein it then bends around within the outer sleeve and exits the superheated steam boiler.

12. The superheated steam boiler of claim 1, further including a double walled lid attached proximate a top surface of the second dry tank, the lid having one or more lid openings allowing an interior of the lid to be in steam communication with the second dry tank and a steam outlet allowing steam generated from the superheated steam boiler to be collected.

13. A method for operating a superheated steam boiler, comprising:

providing a superheated steam boiler, the superheated steam boiler including:

an inner tank system, the inner tank system including a first wet tank and a second dry tank separated from one another by an isolation member;

an outer sleeve at least partially surrounding the inner tank system, wherein one or more wet tank fluid openings proximate a lower surface of the first wet tank allow the first wet tank to be in fluid communication with the outer sleeve, and further wherein one or more dry tank steam openings in the second dry tank allow the second dry tank to be in steam communication with the outer sleeve;

a burner system located primarily within the inner tank system, the burner system including:

a combustion/expansion chamber having one or more spherical surfaces located in and fluidly isolated from the first wet tank;

a distribution chamber located in and fluidly isolated from the second dry tank;

a plurality of heat tubes extending through the isolation member between the combustion/expansion chamber and the distribution chamber; and an exhaust tube extending from the distribution chamber and out of the inner tank system to exit the superheated steam boiler;

filling the outer sleeve and first wet tank with a fluid to a first level; and combusting a flammable material within the combustion/expansion chamber, the combustion of the flammable material causing hot gas to travel up the plurality of heat tubes into the distribution chamber and out the exhaust tube to exit the superheated steam boiler, the hot gas causing the fluid within the first wet tank and outer sleeve to reach its boiling point, wherein superheated steam in the first wet tank and outer sleeve is formed that travels through the one or more dry tank steam openings into the second dry tank and out of the superheated steam boiler.

14. The method as recited in claim 13, wherein four or more heat tubes extend through the isolation member between the combustion/expansion chamber and the distribution chamber, and further wherein the combustion of the flammable material causes hot gas to travel up the four or more heat tubes and into the distribution chamber.

15. The method as recited in claim 14, wherein one or more of the four or more heat tubes have heat distribution loops therein, and further wherein the combustion of the flammable material causes hot gas to travel up the one or more of the four or more heat tubes having heat distribution loops therein and into the distribution chamber.

16. The method as recited in claim 15, wherein one or more of the four or more heat tubes have heat distribution loops therein positioned in the first wet tank and other ones of the four or more heat tubes have heat distribution loops therein positioned in the second dry tank.

17. The method as recited in claim 13, wherein the superheated steam in the outer sleeve travels through one or more steam tubes positioned in the one or more dry tank steam openings and into the second dry tank and out of the superheated steam boiler.

18. The method as recited in claim 17, wherein one or more of the one or more steam tubes have steam loops therein positioned in the second dry tank.

19. The method of claim 17, wherein the number of steam tubes equals the number of heat tubes.

20. The method of claim 13, further including one or more wet tank steam openings proximate an upper surface of the first wet tank to allow the first wet tank to be in steam communication with the outer sleeve.

* * * * *